US011292258B2

(12) United States Patent
Okeguchi et al.

(10) Patent No.: US 11,292,258 B2
(45) Date of Patent: Apr. 5, 2022

(54) HEAD CLEANER, LIQUID DISCHARGE APPARATUS, AND HEAD CLEANING METHOD

(71) Applicant: Ricoh Company, Ltd., Tokyo (JP)

(72) Inventors: Muneyuki Okeguchi, Kanagawa (JP); Kenta Kashiwagi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/068,961

(22) Filed: Oct. 13, 2020

(65) Prior Publication Data

US 2021/0162762 A1 Jun. 3, 2021

(30) Foreign Application Priority Data

Nov. 29, 2019 (JP) ..... JP2019-216063
Mar. 3, 2020 (JP) ..... JP2020-035524

(51) Int. Cl.
*B41J 2/165* (2006.01)
*B41J 3/407* (2006.01)

(52) U.S. Cl.
CPC ..... *B41J 2/16535* (2013.01); *B41J 2/16538* (2013.01); *B41J 2/16544* (2013.01); *B41J 3/4078* (2013.01); *B41J 2002/16558* (2013.01)

(58) Field of Classification Search
CPC ..... B41J 2/16535; B41J 2/16544; B41J 2/16538; B41J 2002/16558; B41J 3/4078
See application file for complete search history.

(56) References Cited

U.S. PATENT DOCUMENTS 5,644,346 A * 7/1997 Schwiebert ..... B41J 2/16547 347/33
2018/0361761 A1 12/2018 Okeguchi et al.
2020/0094582 A1 3/2020 Okeguchi et al.

FOREIGN PATENT DOCUMENTS

JP 2016-112766 6/2016
JP 2020-124895 8/2020

* cited by examiner

*Primary Examiner* — Geoffrey S Mruk
(74) *Attorney, Agent, or Firm* — Xsensus LLP

(57) ABSTRACT

A head clean includes a wiping device configured to wipe a nozzle surface of a head mounted on a carriage, and a holder configured to movably hold the wiping device. The holder includes a connector configured to detachably attach the holder to a guide rod configured to guide a reciprocal movement of the carriage.

18 Claims, 8 Drawing Sheets

HEAD CLEANER, LIQUID DISCHARGE APPARATUS, AND HEAD CLEANING METHOD

CROSS-REFERENCE TO RELATED APPLICATIONS

This patent application is based on and claims priority pursuant to 35 U.S.C. § 119(a) to Japanese Patent Application No. 2019-216063, filed on Nov. 29, 2019, in the Japan Patent Office and Japanese Patent Application No. 2020-035524, filed on Mar. 3, 2020, in the Japan Patent Office, the entire disclosures of which are hereby incorporated by reference herein.

BACKGROUND

Technical Field

Aspects of the present disclosure relate to a head cleaner, a liquid discharge apparatus, and a bead cleaning method.

Related Art

A liquid discharge head includes nozzles on a nozzle surface of the liquid discharge head. The liquid discharge head discharges a liquid from the nozzles. A liquid discharge apparatus such as a printer includes the liquid discharge head and a wiper to wipe and clean the nozzle surface of the liquid discharge head to maintain and recover a performance of the liquid discharge head.

The printer printing an image on a cloth includes a maintenance device. The maintenance device includes the wiper to wipe the nozzle surface of the liquid discharge head.

SUMMARY

In an aspect of this disclosure, a head cleaner includes a wiping device configured to wipe a nozzle surface of a bead mounted on a carriage, and a holder configured to movably hold the wiping device. The holder includes a connector configured to detachably attach the holder to a guide rod configured to guide a reciprocal movement of the carriage.

In another aspect of this disclosure, a head cleaning method includes attaching a connector of a holder configured to hold a wiping device to a guide rod configured to guide a reciprocal movement of a carriage, and moving the wiping device movably held by the holder to wipe a nozzle surface of a head mounted on the carriage with the wiping device.

In still another aspect of this disclosure, a liquid discharge apparatus includes a head configured to discharge a liquid onto a print target, a carriage configured to mount the head, a guide rod configured to guide a reciprocal movement of the carriage, and a head cleaner configured to wipe a nozzle surface of the head. The head cleaner includes a wiping device configured to wipe the nozzle surface of the head mounted on the carriage, and a holder configured to movably hold the wiping device. The holder includes a connector configured to detachably attach the holder to the carriage.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1:
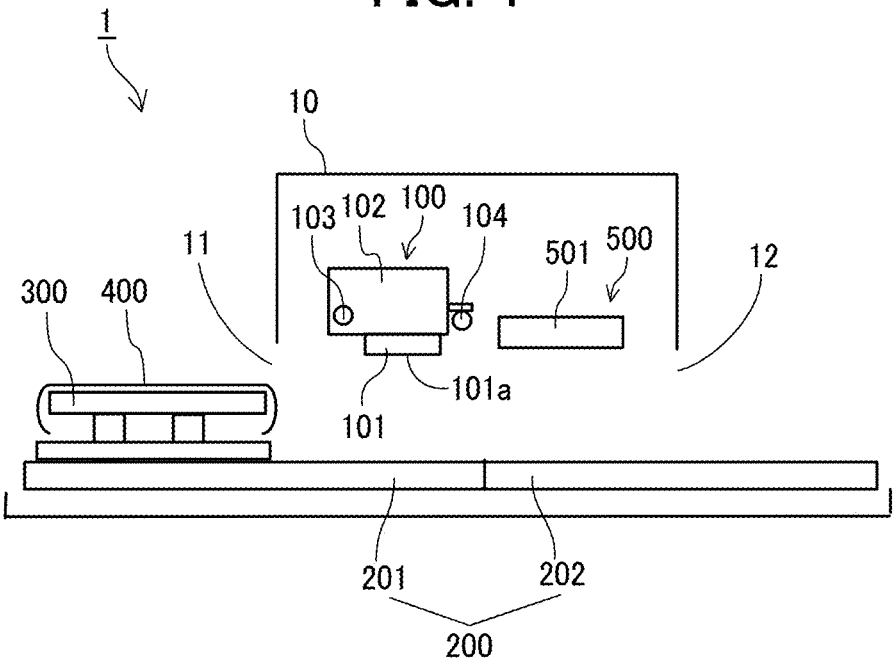
FIG. 1 is a schematic cross-sectional side, view of a printer as a liquid discharge apparatus according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a," "an," and "the" are intended to include the plural forms as well, unless the context clearly indicates otherwise.

Figure 2:
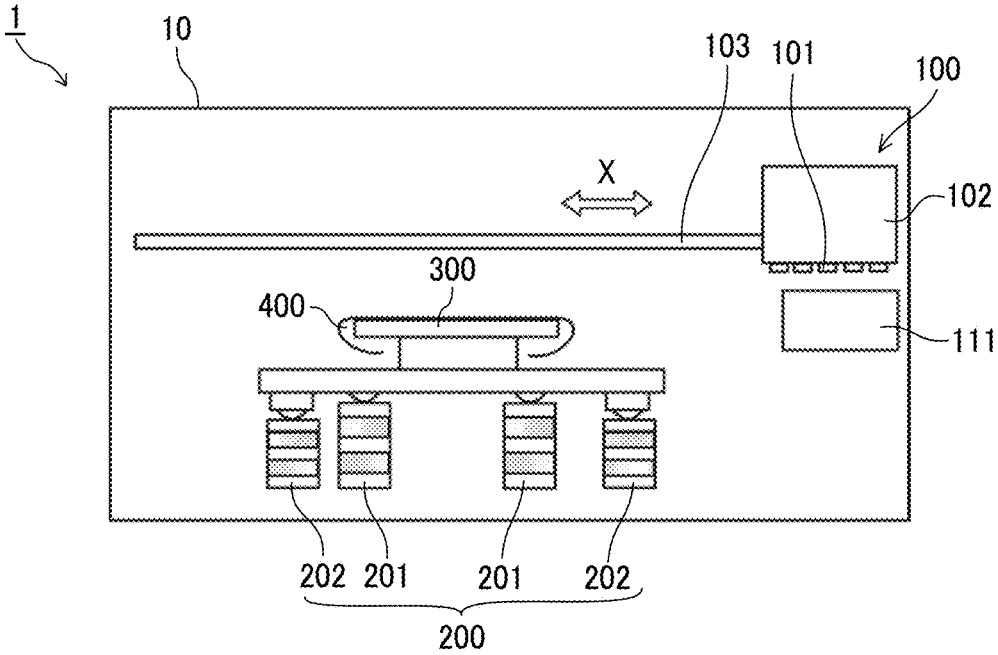
FIG. 2 is a schematic cross-sectional front view of the printer of FIG. 1.
Figure 3:
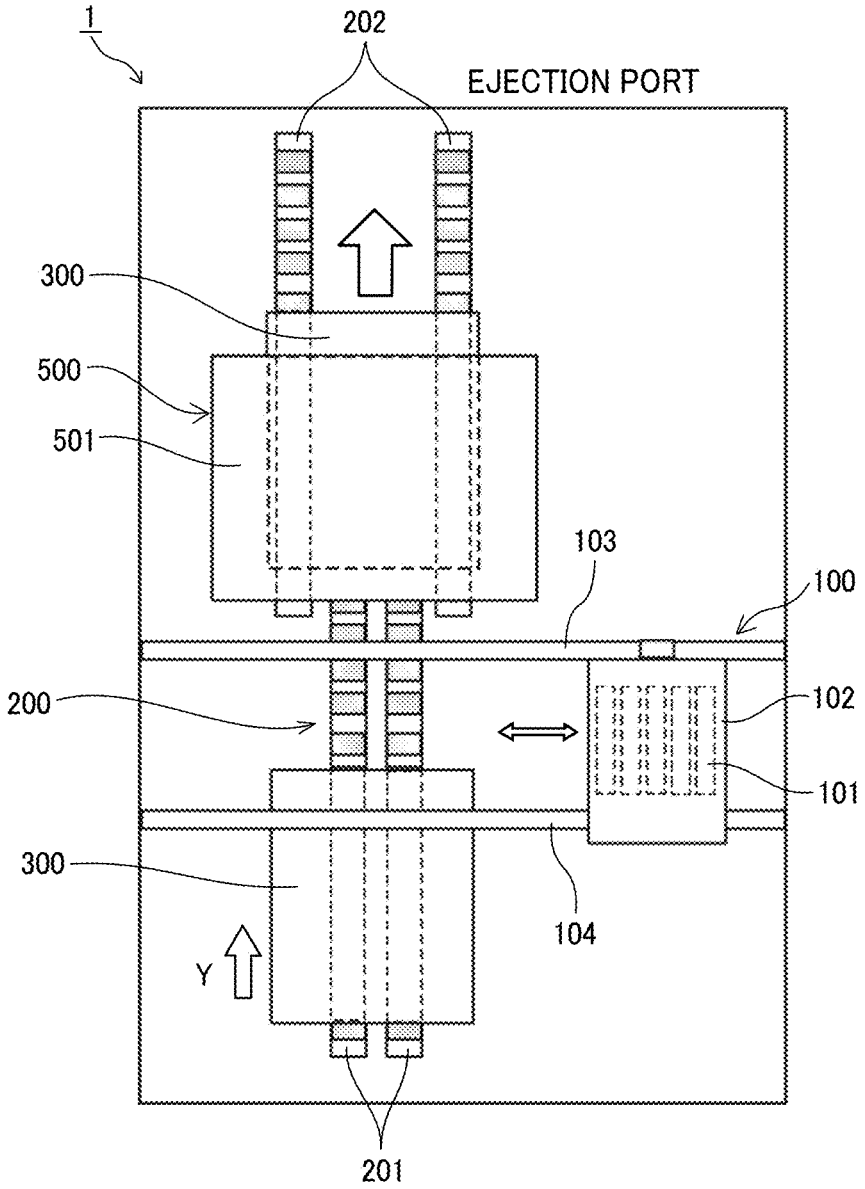
FIG. 3 is a schematic cross-sectional plan view of the printer of FIG. 1.

Referring now to the drawings, wherein like reference numerals designate identical or corresponding parts throughout the several views, embodiments of the present disclosure are described below. A printer 1 as a liquid discharge apparatus according to a first embodiment of the present disclosure is described with reference to FIGS. 1 and 3. FIG. 1 is a schematic cross-sectional side view of the printer 1 according to the first embodiment of the present disclosure. FIG. 2 is a schematic cross-sectional front view of the printer 1 according to the first embodiment of the present disclosure. FIG. 3 is a schematic cross-sectional plan view of the printer 1 according to the first embodiment of the present disclosure.

The printer 1 includes a printing device 100 and a heater 500 in an apparatus body 10. The printing device 100 prints on the cloth 400 as a print target held by a tray 300 as a holder. The heater 500 heats the cloth 400 as the prim target printed by the printing device 100. The print target is also referred to as a "medium to be printed" or an "object to be printed."

The printer 1 further includes a conveyor 200. The conveyor 200 configures a conveyance path that feeds the tray 300 as the holder from a feed port 11 of the apparatus body 10 and conveys the tray 300 from an ejection port 12 via the printing device 100 and the heater 500.

The printing device 100 includes one or a plurality of liquid discharge beads 101 to discharge a liquid and a carriage 102 mounting the one or the plurality of liquid discharge heads 101. Hereinafter, the one or the plurality of liquid discharge heads is simply referred to as a "head." The printer 1 includes a main guide 103 and a sub guide 104 as a guide rod to guide the carriage 102 so that the carriage 102 is reciprocally movable in a main-scanning direction as indicated by arrow "X."

The printer 1 further includes a maintenance device 111 (see FIG. 2) including a cap, to cap a nozzle surface 101*a* of the head 101, The maintenance device 111 arranged on a home position side (right side in FIG. 2) of the carriage 102.

The heater 500 includes, for example, a heater 501. The heater 500 may include devices such as a contact heater such as a hot-air dryer and a press using a hot plate, and a non-contact heater such as an infrared heater.

A timing belt, a conveyor, or the like may configure the conveyor 200. The conveyor 200 includes a first conveyor 201 and a second conveyor 202. The first conveyor 201 conveys the tray 300 (print target) in a sub-scanning direction indicated by arrow "Y" so that the tray 300 (print target) faces the printing device 100. The second conveyor 202 conveys the tray 300 in the sub-scanning direction Y so that the tray 300 faces the heater 500.

The tray 300 can detachably hold the cloth 400 such as a T-shirt as the print target. The print target is an object onto which a liquid is applied. The holder may have a cassette structure as well as a tray structure. The holder may be any member as long as the holder can hold the print target.

Next, a head cleaner 600 according to the fast embodiment of the present disclosure is described with reference to FIGS. 4 to 7.

Figure 4:
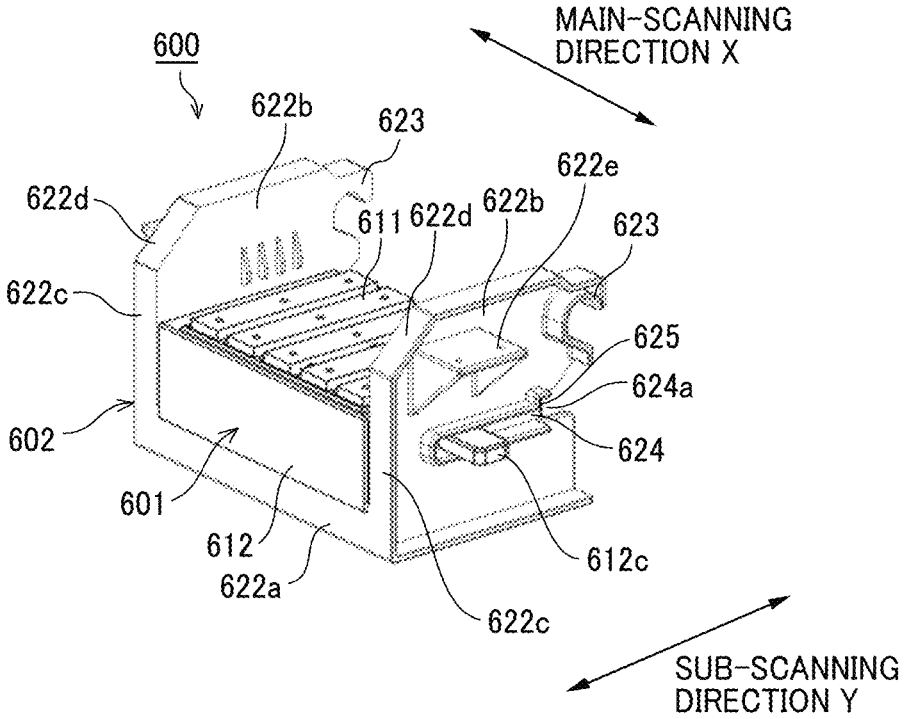
FIG. 4 is a schematic perspective view a head cleaner according to a first embodiment of the present disclosure.

FIG. 4 is a schematic perspective view of the head cleaner 600 according to the first embodiment of the present disclosure.

Figure 5:
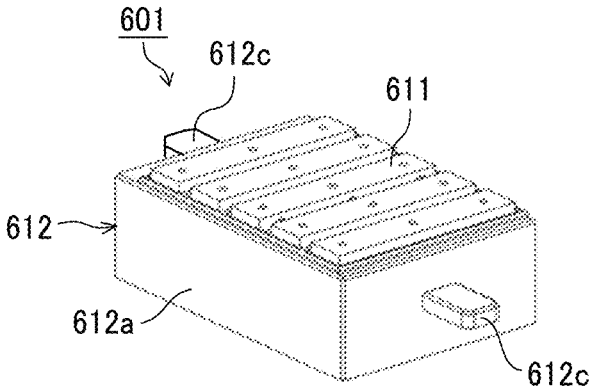
FIG. 5 is a schematic perspective view of a wiping device of the head cleaner of FIG. 4.

FIG. 5 is a schematic perspective view of a wiping device 601 of the head cleaner 600 of FIG. 4.

Figure 6:
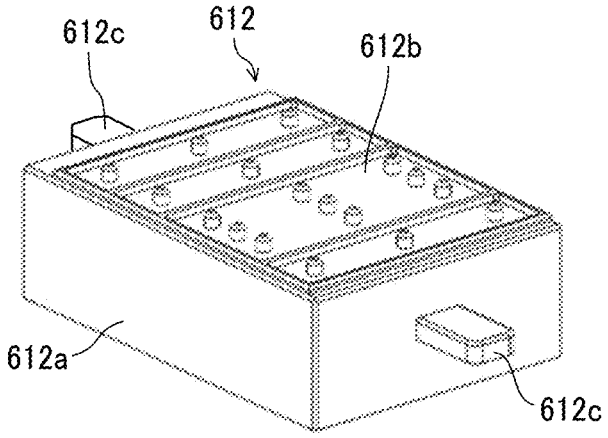
FIG. 6 is a schematic perspective view of a slider of FIG. 4.

FIG. 6 is a schematic perspective view of a slider 612 of FIG. 4.

Figure 7:
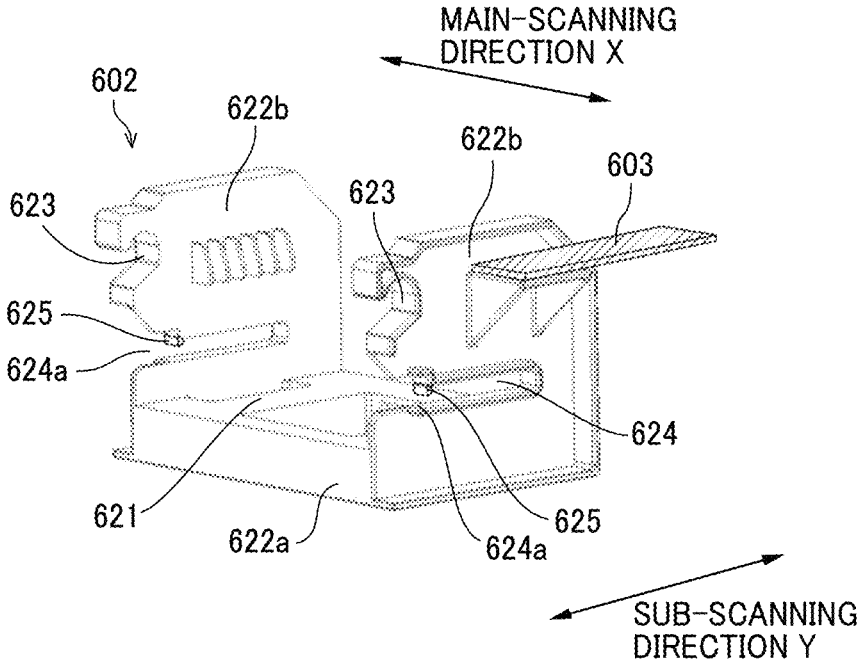
FIG. 7 is a schematic perspective view of a holder of FIG. 4.

FIG. 7 is a schematic perspective view of a holder 602 of FIG. 4.

The head cleaner 600 includes a wiping device 601 and a holder 602 to movably hold the wiping device 601.

The wiping device 601 includes a wiper 611 such as an absorber and a slider 612 to which the wiper 611 is attached.

The slider 612 includes a slider body 612*a* and a holding member 612*b*. The slider body 612*a* has a box shape. The holding member 612*b* is arranged inside the slider body 612*a* and detachably holds the wiper 611. Further, the slider 612 includes a convex portion 612*c* as a knob on outer side surfaces of the slider body 612*a* to manually operate the slider 612 as illustrated in FIG. 5. The head cleaner 600 according to the first embodiment can set a plurality of wipers 611 on the slider 612.

Further, the wipers 611 (five in FIG. 5) are arranged to correspond to the heads 101 (five in FIG. 3) that discharge inks of colors of cyan (C), magenta (M), Yellow (Y), black (K), and white (W), respectively, for example.

A cleaning liquid is generally applied to the wiper to remove dirt adhering to the head 101. Here, the wiper 611 is preferably a "member that can hold as much cleaning liquid as possible such as a sponge". However, the member such as sponge is difficult to be used, in a conventional wiper mechanism incorporated in an apparatus body of a printer because of problems of replacement frequency and installation space. Conversely, the wiper 611 according to the first embodiment is easily detachably attachable to the apparatus body 10. Thus, the wiper 611 is easy to be cleaned and replaced. Thus, the wiper 611 according to the first embodiment can use a sponge that was difficult to use for a wiper in the past.

Particularly, white pigments such as titanium oxide contained in white ink are hard. Thus, the white ink is difficult to be wiped cleanly with a wiper used in the past. Further, there was a risk of damaging the nozzle surface during wiping the white ink. Further, white pigments such as titanium oxide have a large particle size. Thus, a web soaked with a cleaning liquid has a small amount of voids with respect to the particle size of the white pigments. Thus, it is difficult for the web to efficiently absorb the white pigment (dirt). Therefore, it is preferable to use a sponge having a relatively large void amount, particularly, for the bead (or nozzle row) that discharges white ink as in the head cleaner 600 according to the first embodiment.

The holder 602 includes a holding portion 621 that movably holds the wiping device 601. A bottom 622*a*, and side plates 622*b* and 622*b* on both sides of the bottom 622*a* form the holding portion 621 of the holder 602.

Each of the side plates 522*b* and 622*b* of the holder 602 includes a hook 623 as an example of a connector to be hooked to the main guide 103 of the printer 1. The hook 623 detachably connects the head cleaner 600 to the main guide 103.

Further, the side plate 622*b* of the holder 602 includes a groove-shaped (slit-shaped) guide slit 624 that movably guides the convex portion 612*c* of the slider 612 of the wiping device 601 so that the slider 612 is slidably movable in the sub-scanning direction Y that is a moving direction of the wiping device 601. The convex portion 612*c* of the slider 612 is fitted into the guide slit 624 so that the convex portion 612*c* slidably moves along the guide slit 624. The guide slit 624 may be a groove without opening.

Further, the holder 602 includes openings 624*a* at each end of the guide slit 624. More specifically, each of the opening 624*a* is disposed at one end side (left side in FIG. 7) of the guide slit 624 in the sub-scanning direction Y at which the hook 623 is formed. The convex portion 612*c* is removable from the guide slit 624 through the opening 624*a*.

Further, the opening 624*a* includes a stopper 625. An elastic member or a combination of a resin member and a spring may form the stopper 625. The stopper 625 is hooked on to the convex portion 612*c* in the guide, slit 624 so that the slider 612 is not easily detached from the holder 602.

Further, the holder 602 includes walls 622*c* (see FIG. 4) at another end of the guide slit 624 (side plate 622*b*) opposite to one end side (left side in FIG. 4 and right side in FIG. 7) in the sub-scanning direction Y at which the hook 623 is formed.

Further, both side plates 622*b* of the holder 602 include a fixing-plate attachment portion 622*e* as illustrated in FIG. 4. A fixing plate 603 as described below is attached to the fixing-plate attachment portion 622*e* as illustrated in FIG. 7.

Further, the holder 602 includes an inclined portion 622*d* as a notch on a corner of each side plate 622*b* of the holder 602. Specifically, the inclined portion 622*d* is at an upper surface of the side plate 622*b* on another end side in the sub-scanning direction Y at which the wall 622*c* is formed, that is, the another end side opposite to the one end side at which the hook 623 is formed.

Figure 8A:
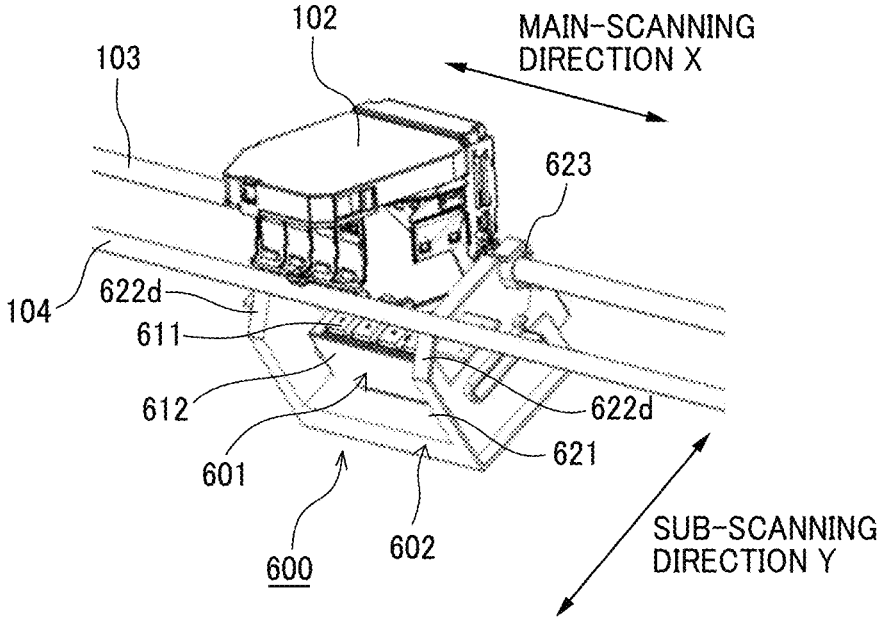
FIGS. 8A and 8B are a schematic perspective views of a carriage and the head cleaner connected to a main guide and a sub guide.
Figure 8B:
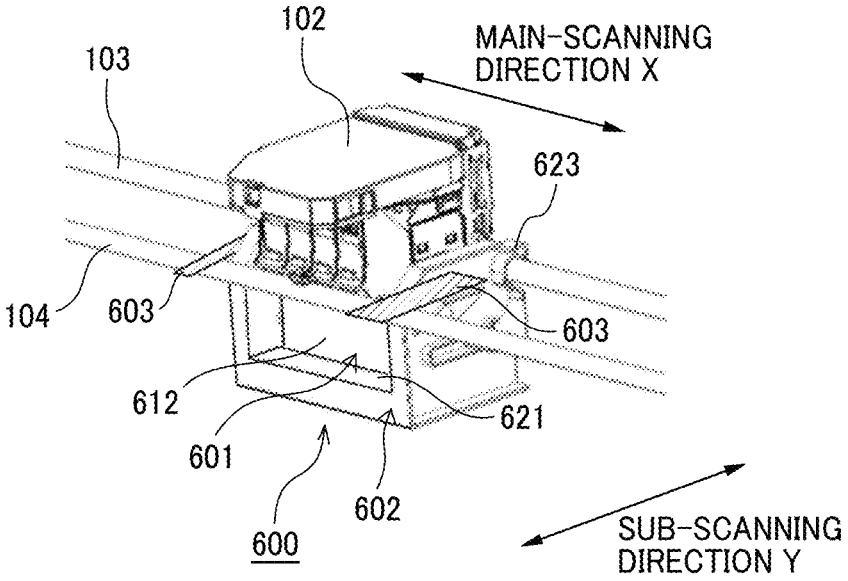

Next, a cleaning method of the head cleaner 600 according to the first embodiment is described with reference to FIGS. 8A and 8B. FIGS. 8A and 8B are a schematic perspective views of the carriage 102 and the head cleaner 600 connected to the main guide 103 and the sub guide 104 as the guide.

As illustrated in FIG. 8A, the hook 623 of the holder 602 of the head cleaner 600 is hooked and connected to the main guide 103 as the guide. The hook 623 is hooked on to the main guide 103 that is one of two guides of the main guide 103 and the sub guide 104. The main guide 103 is on one end side (upper side in FIG. 3) at which the ejection port 12 is disposed in the sub-scanning direction Y. The cloth 400 as the print target (medium to be printed) is ejected from the ejection port 12 of the printer 1.

Then, as illustrated in FIG. 8B, the holder 602 is rotated to bring the wiper 611 of the wiping device 601 into contact with the nozzle surface 101*a* of the head 101.

The fixing plate 603 as an example of the connector is attached to the fixing-plate attachment portion 622*e*. Thus, at time of contact between the wiper 611 and the nozzle surface 101*a*, the head cleaner 600 (holder 602) is fixed (attached) to the main guide 103 and the sub guide 104 (guide rod). The head cleaner 600 according to the first embodiment uses the fixing-plate attachment portion 622*e* (see FIG. 4) and the fixing plate 603 (see FIG. 7) to fix the head cleaner 600 to the sub guide 104 (see FIG. 8B). However, the fixing method is not limited to the embodiment as described above. For example, a fixing method of the connector may be a fixing method by a magnet or a fixing method by a snap fit.

Further, the holder 602 has the inclined portion 622*d* described above. In fixing work from FIG. 8A to FIG. 8B, a part of the holder 602 does not come into contact with the sub guide 104. Considering attachability of the holder 602 and a sliding range of the wiping device 601, the holder 602 preferably has a size as large as possible. Provision of such an inclined portion 622*d* can secure the attachability of the holder 602 and the sliding range of the wiping device while prevent the holder 602 from interfering with the apparatus body 10. The shape of the inclined portion 622*d* (notch) may be any shape such as round chamfering plane (R-plane), C chamfering plane (C-plane), notch, or the like.

Further, the holder 602 includes the above-described walls 622*c* (see FIG. 4) at another end side (left side in FIG. 4 and right side in FIG. 7) of the guide slit 624 (side plate 622*b*) opposite to one end side (right side in FIG. 4 and left side in FIG. 7) in the sub-scanning direction Y at which the hook 623 is formed. Fixing work from FIG. 8A to FIG. 8B can prevent the bolder 602 from falling from the guide rod (main guide 103 and sub guide 104) by its own weight.

When the holder 602 is attached (fixed) to the main guide 103 and the sub guide 104 (guide rod), the user holds the convex portion 612*c* of the slider 612 of the wiping device 601 and manually moves the slider 612 along the guide slit 624 in the sub-scanning direction Y. Thus, the nozzle surface 101*a* of the head 101 is wiped and cleaned by the wiper 611. Further, the holder 602 is detachably attachable to the main guide 103 and the sub guide 104 (at least two guide rods).

Thus, the main guide 103 and the sub guide (guide rods) are configured to guide a reciprocal movement of the carriage 102 in the main-scanning direction X, and the holder 602 is configured to movably hold the slider 612 in a sub-scanning direction Y perpendicular to the main-scanning direction X.

Thus, the head cleaner 600 can easily clean the nozzle surface 101*a* that faces downward of the bead 101.

The wiping device 601 includes the plurality of wipers 611 (five in FIG. 5) for the plurality of heads 101 (five in FIG. 3), respectively. Thus, the head cleaner 600 can wipe and clean the nozzle surfaces 101*a* of the plurality of heads 101 at one time.

Thus, the head cleaner 600 can clean the nozzle surface 101*a* of the head in a short cleaning time.

The bead cleaning method according to the first embodiment includes following two processes of a first process and a second process. The first process detachably attach the holder 602 of the head cleaner 600 to the main guide 103 by the hook 623 (connector). The head cleaner 600 includes the wiping device 601 to wipe the nozzle surface 101*a* of the head 101 and the holder 602 to hold the wiping device 601. The main guide 103 reciprocally movably guides the carriage 102 mounting the head 101. The main guide 103 is disposed at one end side closed to the ejection port 12 with respect to the sub guide 103 as illustrated in FIG. 3. The second process moves the wiping device 601 movably held by the holder 602 to wipe the nozzle surface 101*a* of the head 101.

The holder 602 of the head cleaner 600 may include a drive source and a drive mechanism to reciprocally move the slider 612 to automatically wipe and clean the nozzle surface 101*a* of the head 101.

Further, a shape of the wiper 611 is matched with a shape of the nozzle surface 101*a* of the head 101 so that the head cleaner 600 can mote effectively wipe and clean the nozzle surface 101*a* of the head 101.

Further, the wipers 611 used for cleaning may be made of different materials or have different shapes. For example, a material and a shape of the wiper 611 to clean the head 101 that discharges the color liquid and a material and a shape of the wiper 611 to clean the head 101 that discharges the white liquid are different. Thus, the head cleaner 600 can effectively wipe the heads 101 according to types of liquids such as color liquids and white liquids that are different in degree of dirt and removability of dirt adhered to the nozzle surface 101*a* of the head 101.

The wiper 611 moves in the sub-scanning direction Y since the guide slit 624 is formed along the sub-scanning direction Y according to the first embodiment of the present disclosure. However, the guide slit 624 may be formed along the main scanning direction X so that the wiper 611 moves in the main-scanning direction X.

Further, the guide slit 624 is configured to be parallel to the nozzle surface 101*a* of the head 101 when the holder 602 is attached to the main guide 103 and the sub guide 104 in the head cleaner 600 according to the first embodiment. Thus, the distance between the slider 612 and the nozzle surface 101*a* is kept substantially constant so that the wiper 611 can wipe the nozzle surface with even wiping force when the user moves the slider 612. That is, the head cleaner 600 can reduce uneven wiping force of the wiper 611 when the wiper 611 wipes the nozzle surface 101*a* of the head 101.

Particularly, the nozzle surface 101*a* of the head 101 that discharges an ink (white ink, for example) containing titanium oxide and the like that is hard and has a large particle size may be damaged when the wiper 611 wipes the nozzle surface 101*a* of the head 101 with excessive strong force (maximum wiping power). Thus, the above-described effects such as reduction of uneven wiping force and limitation of maximum wiping power are important.

The head cleaner 600 according to a second embodiment of the present disclosure is described with reference to FIGS. 9 and 10.

Figure 9:
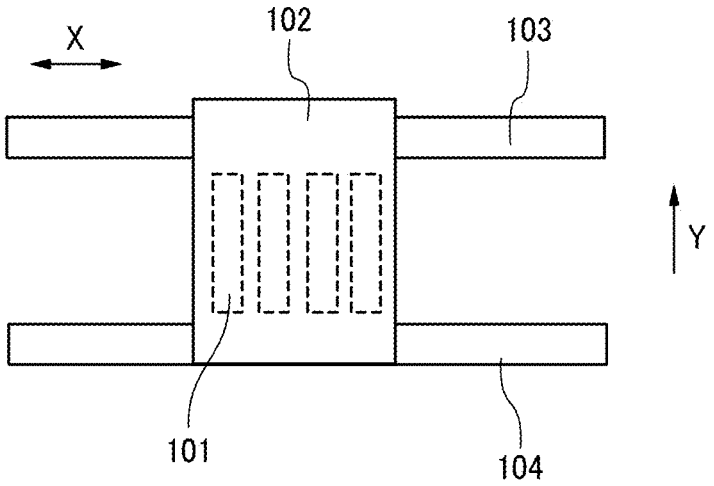
FIG. 9 is a schematic plan view of a carriage connected to the head cleaner according to a second embodiment of the present disclosure.

FIG. 9 is a schematic plan view of a carriage 102 connected to the head cleaner 600 according to the second embodiment of the present disclosure.

Figure 10:
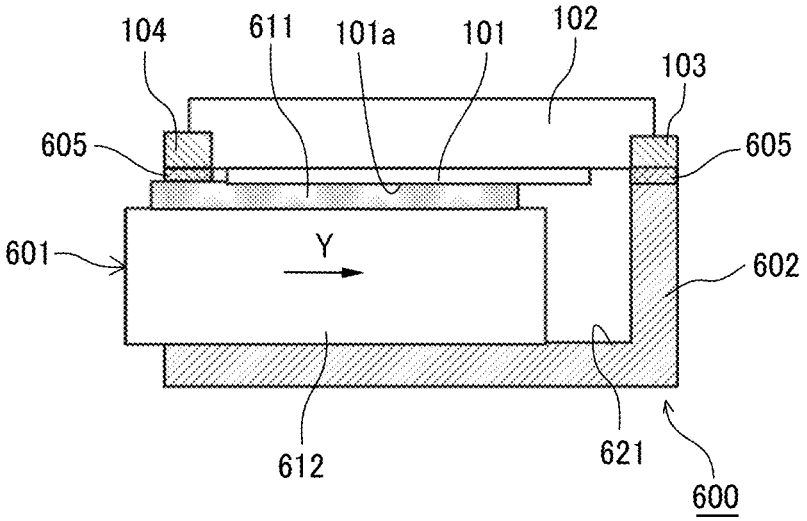
FIG. 10 is a schematic cross-sectional side view of the carriage connected to the head cleaner.

FIG. 10 is a schematic cross-sectional side view of the carriage 102 connected to the head cleaner 600.

A stay having a rectangular cross-section may configure each of the main guide 103 and the sub guide 104 (guide rods) to guide the carriage 102 in the second embodiment. Thus, the main guide 103 and the sub guide 104 in the second embodiment are not rod in the first embodiment as illustrated in FIGS. 8A and 8B.

The holder 602 of the head cleaner 600 thus configured can be connected to such the guide rods (main guide 103 and the sub guide 104) having rectangular cross section. Thus, the head cleaner 600 according to the second embodiment can obtain a similar effect with an effect obtained by the head cleaner 600 according to the first embodiment.

Further, the head cleaner 600 according to the second embodiment includes a magnet 605 made of a magnetic material as a connector of the holder 602. Thus, the holder 602 can be fixed to each of the main guide 103 and the sub guide 104 (guide rods).

Next, the head cleaner 600 according to a third embodiment of the present disclosure is described with reference to FIG. 11.

Figure 11:
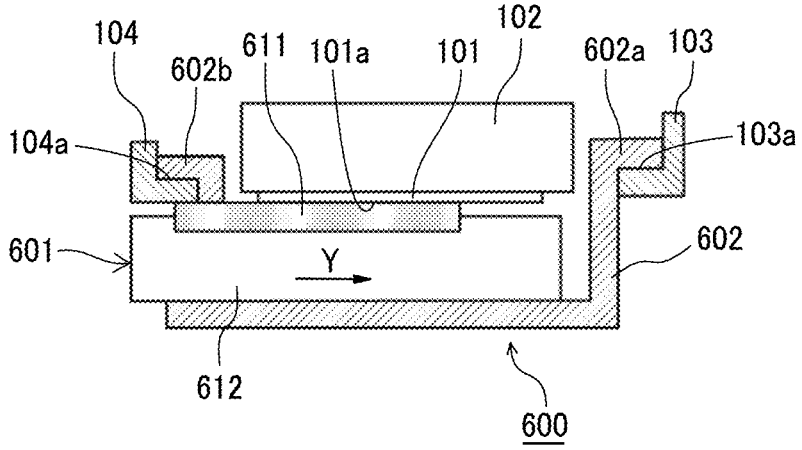
FIG. 11 is a schematic cross-sectional side view of the carriage which the head cleaner according to the third embodiment is connected.

FIG. 11 is a schematic cross-sectional side view of the carriage 102 in a state in which the head cleaner 600 according to the third embodiment is connected to the carriage 102.

The main guide 103 and the sub guide 104 (guide rods) in the third embodiment are angle bars having different shape from the shape of the main guide 103 and the sub guide 104 in the second embodiment. To fix (attach) the holder 602 to the main guide 103 and the sub guide 104 (guide rods) in the third embodiment as illustrated in FIG. 11, the holder 602 includes hooks 602*a* and 602*b* (angles) so that the hook 602*a* is hooked on to (engages with) a flat surface 103*a* of the main guide 103, and the hook 6021 is hooked on to (engages with) a flat surface 104*a* of the sub guide 104.

Next, the head cleaner 600 according to a fourth embodiment of the present disclosure is described with reference to FIG. 12.

Figure 12:
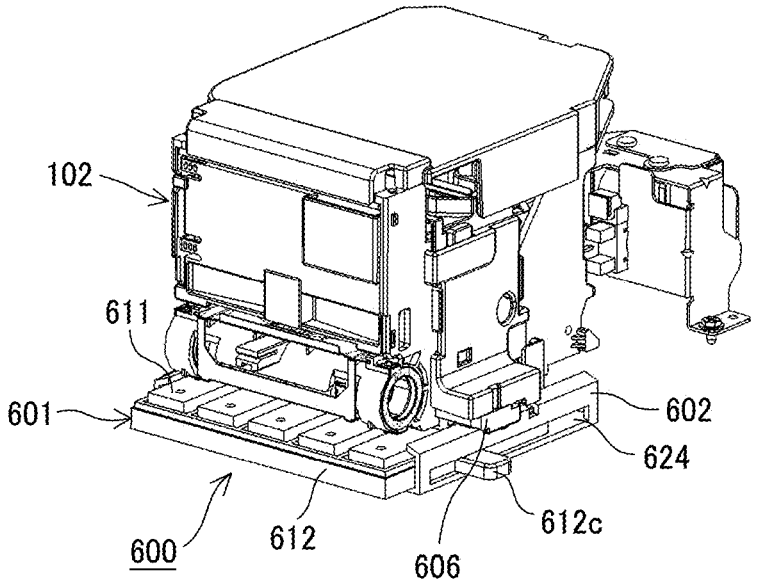
FIG. 12 is a schematic perspective view of the carriage connected to the lead cleaner according to a fourth embodiment of the present disclosure.

FIG. 12 is a schematic perspective view of a carriage 102 connected to the head cleaner 600 according to the fourth embodiment of the present disclosure.

The head cleaner 600 according to the fourth embodiment includes the holder 602 detachably attached to the carriage 102. For example, the head cleaner 600 includes a connector 606 that includes a member using a magnet or an engagement part, for example, to detachably attach the holder 602 to the carriage 102.

Thus, the head cleaner 600 according to the fourth embodiment can obtain a similar effect with an effect obtained by the head cleaner 600 according to the first embodiment. Further, the holder 602 of the head cleaner 600 is directly connected to the carriage 102 so that the holder 602 is prevented from damaging the main guide 103 and the sub guide 104 (guide rod) that guides the carriage 102.

Next, the head cleaner 600 according to a fifth embodiment of the present disclosure is described with reference to FIG. 13.

Figure 13:
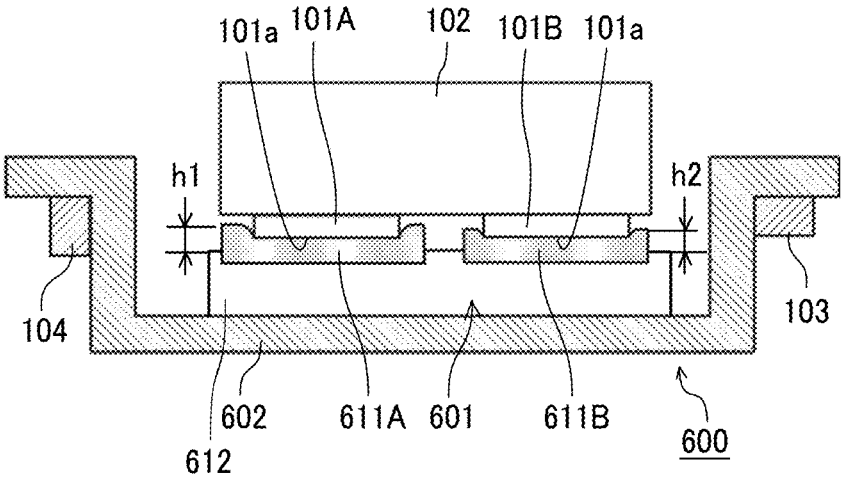
FIG. 13 is a schematic cross-sectional side view of the carriage connected to the head cleaner according to a third embodiment of the present disclosure.

FIG. 13 is a schematic cross-sectional side view of the carriage 102 in a state in which the head cleaner 600 according to the fifth embodiment is connected to the carriage 102.

The head cleaner 600 in the fifth embodiment includes a sponge 611A and 611B. The sponge 611A corresponds to a color head 101A including a color nozzle array to discharge color ink. The sponge 611B corresponds to a white head 101B including a white nozzle array to discharge white ink. The white ink contains at least a white pigment such as titanium oxide and an organic solvent.

Here, "h1" illustrated in FIG. 13 is a height from an upper surface of the slider 612 to an upper surface of the sponge 611A, and "h2" is a height from an upper surface of the slider 612 to an upper surface of the sponge 611B. The height h1 is larger than the height h2 (h1>h2).

Thus, the wiping device 601 includes a first wiper (sponge 611A) configured to wipe the color nozzle array (color head 101A) and a second wiper (sponge 611B) configured to wipe the white nozzle array (white had 101B). A height (h1) of the first wiper (sponge 611A) is higher than a height (h2) of the second wiper (sponge 611B) when the holder 602 is attached (connected) to the main guide 103 and the sub guide 104 (guide rod).

Thus, the sponge 611B that wipes the white ink containing the white pigment such as titanium oxide with a relatively small wiping force to reduce damaging the nozzle surface 101*a* of the head 101 that discharges white ink. The wiping force of the sponge 611B is smaller than the wiping force of the sponge 611A. A moving speed, frequency, and the like of the wiper 611 moved by the user are not constant in the head cleaner 600 in the fifth embodiment. Thus, particularly, it is preferable to previously set the wiping force of the sponge 611B for the white ink to be small.

In the above-described embodiments, the printer is described that prints an image on a cloth as an object to which a liquid is applied. The printer is an example of the liquid discharge apparatus that is detachably attachable the head cleaner as described above. However, liquid discharge apparatus is not limited to the printer that prints on the cloth. For example, liquid discharge apparatus may be a printer that discharge a liquid onto a sheet material as the object to which a liquid is applied.

In the above-described embodiments, the "liquid discharge apparatus" includes the head or the liquid discharge device and drives the head to discharge liquid. The liquid discharge apparatus may be, for example, an apparatus capable of discharging liquid to a material onto which liquid can adhere and an, apparatus to discharge liquid toward gas or into liquid.

The "liquid discharge apparatus" may include devices to feed, convey, and eject the material onto which liquid can adhere. The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional fabrication apparatus to discharge a fabrication liquid to a powder layer in which powder material is formed in layers to form a three-dimensional fabrication object.

The "liquid discharge apparatus" is not limited to an apparatus to discharge liquid to visualize meaningful images, such as letters or figures. For example, the liquid discharge apparatus may be an apparatus to form arbitrary images, such as arbitrary patterns, or fabricate three-dimensional images.

The above-described term "material onto which liquid can adhere" represents a material on which liquid is at least temporarily adhered, a material on which liquid is adhered and fixed, or a material into which liquid is adhered to permeate.

Examples of the "material onto which liquid can adhere" include recording media, such as paper sheet, recording paper, recording sheet of paper, film, and cloth, electronic component, such as electronic substrate and piezoelectric element, and media, such as powder layer, organ model, and testing cell.

The "material onto which liquid can adhere" includes any material on which liquid is adhered, unless particularly limited.

Examples of the "material onto which liquid can adhere" include any materials on which liquid can adhere even temporarily, such as paper, thread, fiber, fabric, leather, metal, plastic, glass, wood, and ceramic.

Further, the term "liquid" includes any liquid having a viscosity or surface tension that is dischargeable from the head.

However, preferably, the viscosity of the liquid is not greater than 30 mPa·s under ordinary temperature and ordinary pressure or by heating or cooling.

Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant.

Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

The "liquid discharge apparatus" may be an apparatus to relatively move the head and a material onto which liquid an adhere. However, the liquid discharge apparatus is not limited to such an apparatus.

For example, the "liquid discharge apparatus" may be a serial head apparatus that moves the head, a line head apparatus that does not move the head, or the like.

Examples of the "liquid discharge apparatus" further include a treatment liquid coating apparatus to discharge a treatment liquid to a sheet surface to coat the sheet with the treatment liquid to reform the sheet surface and an injection granulation apparatus to discharge a composition liquid including a raw material dispersed in a solution from a nozzle to mold particles of the raw material.

Numerous additional modifications and variations are possible in light of the Above teachings, it is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A head cleaner comprising:

a wiping device configured to wipe a nozzle surface of a head mounted on a carriage; and a holder configured to movably hold the wiping device, the wiping device being movable with respect to the holder, wherein the holder includes a connector configured to detachably attach the holder to a guide rod configured to guide a reciprocal movement of the carriage.

2. The head cleaner according to claim 1, wherein the wiping device includes:

a wiper configured to wipe the nozzle surface of the head; and a slider configured to hold the wiper, and the holder movably holds the slider.

3. The head cleaner according to claim 2, wherein the wiper is detachably attached to the slider.

4. The head cleaner according to claim 2, wherein the holder includes a guide slit along a moving direction of the wiping device, and the slider includes a convex portion fitted into the guide slit, and the slider is configured to slidably move along the guide slit.

5. The head cleaner according to claim 4, wherein the guide slit is parallel to the nozzle surface of the head when the holder is attached to the guide rod.

6. The head cleaner according to claim 2, wherein the guide rod is configured to guide the reciprocal movement of the carriage in a main-scanning direction, and the holder is configured to movably hold the slider in a sub-scanning direction perpendicular to the main-scanning direction.

7. A head cleaner according to claim 1, wherein the connector includes a hook to be detachably hooked on the guide rod.

8. A head cleaner according to claim 1, wherein the connector is a magnet.

9. A liquid discharge apparatus comprising:

a head configured to discharge a liquid onto a print target;

a carriage configured to mount the head;

a guide rod configured to guide a reciprocal movement of the carriage; and the head cleaner according to claim 1.

10. The liquid discharge apparatus according to claim 9, wherein the guide rod includes at least two guide rods, the carriage is disposed between said at least two guide rods in a sub-scanning direction perpendicular to a moving direction of the carriage, wherein the holder is detachably attachable to said at least two guides.

11. The liquid discharge apparatus according to claim 10, further comprising:

an ejection port from which the print target is ejected, the ejection port disposed at one end side of the liquid discharge apparatus in the sub-scanning direction along which the print target is conveyed, wherein said at least two guide rods includes:

a first guide rod disposed at said one end side in the sub-scanning direction; and a second guide rod disposed at another end side opposite to said one end side in the sub-scanning direction, the connector includes a hook to be detachably hooked on the first guide rod.

12. The liquid discharge apparatus according to claim 11, wherein the holder includes a notch at said another end side in the sub-scanning direction.

13. A liquid discharge apparatus according to claim 11, wherein the holder includes a wall at said another end side in the sub-scanning direction.

14. A liquid discharge apparatus according to claim 9, further comprising:

a color nozzle array configured to discharge a color ink;

a white nozzle array configured to discharge a white ink;

wherein the wiping device includes:

a first wiper configured to wipe the color nozzle array; and a second wiper configured to wipe the white nozzle array, and a height of the first wiper is higher than a height of the second wiper when the holder is connected to the guide rod.

15. The liquid discharge apparatus according to claim 9, wherein the head discharges a liquid onto a cloth.

16. A head cleaning method, comprising: wiping the nozzle surface of the head mounted on the carriage with the head cleaner of claim 1.

17. A liquid discharge apparatus comprising:

a head configured to discharge a liquid onto a print target;

a carriage configured to mount the head;

a guide rod configured to guide a reciprocal movement of the carriage; and a head cleaner configured to wipe a nozzle surface of the head, wherein the head cleaner comprises:

a wiping device configured to wipe the nozzle surface of the head mounted on the carriage; and a holder configured to movably hold the wiping device, the wiping device being movable with respect to the holder, wherein the holder includes a connector configured to detachably attach the holder to the carriage.

18. The liquid discharge apparatus according to claim 17, wherein the wiping device includes:

a wiper configured to wipe the nozzle surface of the head; and a slider configured to hold the wiper, the guide rod is configured to guide the reciprocal movement of the carriage in a main-scanning direction, and the holder is configured to movably hold the slider in a sub-scanning direction perpendicular to the main-scanning direction.

* * * * *